US011974668B2

(12) United States Patent
Brown et al.

(10) Patent No.: US 11,974,668 B2
(45) Date of Patent: May 7, 2024

(54) ADJUSTABLE STORAGE ASSEMBLY WITH PIVOTAL BARS

(71) Applicant: LIBERTY HARDWARE MFG. CORP., Winston-Salem, NC (US)

(72) Inventors: Tara Brown, High Point, NC (US); Robert Douglas Hegarty, Winston-Salem, NC (US); James Allen Austin, III, High Point, NC (US); Michael Witt, Kernersville, NC (US); Jeffrey John Mathison, Chicago, IL (US); Margaret Rider, Winston-Salem, NC (US); Rose Ford, Winston-Salem, NC (US); Ethan Creasman, Raleigh, NC (US); Gabriel Prero, Chicago, IL (US); Patrick William Boehnen, Summerfield, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 150 days.

(21) Appl. No.: 17/477,878

(22) Filed: Sep. 17, 2021

(65) Prior Publication Data

US 2023/0092929 A1 Mar. 23, 2023

(51) Int. Cl.
*A47B 88/90* (2017.01)
*A47B 61/04* (2006.01)
(Continued)

(52) U.S. Cl.
CPC ..... *A47B 88/9412* (2017.01); *A47B 61/04* (2013.01); *A47B 88/407* (2017.01); *A47B 88/60* (2017.01); *A47B 2210/01* (2013.01)

(58) Field of Classification Search
CPC ... A47B 88/9412; A47B 61/04; A47B 88/407; A47B 88/60; A47B 2210/01;
(Continued)

(56) References Cited

U.S. PATENT DOCUMENTS 240,317 A * 4/1881 Greeve ..... A47G 25/0685 211/99
1,404,270 A * 1/1922 Carr ..... A47F 7/08 312/328

(Continued)

FOREIGN PATENT DOCUMENTS

JP H626183 Y2 7/1994
KR 200383593 Y1 5/2005

OTHER PUBLICATIONS

The Organised Store, Elfa Shelving & Storage, 2016, 19 pages.
Hafele, Bedroom Fittings and Accessories, 2017, 39 pages.

*Primary Examiner* — Hiwot E Tefera
(74) *Attorney, Agent, or Firm* — BROOKS KUSHMAN P.C.; Lora Graentzdoerffer

(57) ABSTRACT

A storage assembly is provided with a pair of spaced apart brackets. A pair of hubs is each pivotally connected to one of the pair of spaced apart brackets. A rotary limit is connected to one of the pair of hubs and one of the pair of spaced apart brackets to limit the pair of hubs to a range of rotation relative to the pair of spaced apart brackets. A pair of bars is each connected to the pair of hubs to rotate with the pair of hubs to support and store articles upon the pair of bars.

20 Claims, 9 Drawing Sheets

(51) Int. Cl.
*A47B 88/407* (2017.01)
*A47B 88/60* (2017.01)

(58) Field of Classification Search
CPC ..... A47B 61/00; A47B 61/02; A47B 57/04; A47B 47/028; A47B 96/1441; A47B 47/0058; A47B 47/0083; A47B 81/007; A47B 47/045; A47B 57/045; A47B 49/002; A47B 63/065; A47B 88/48; A47G 25/02; A47G 25/0685; A47F 7/08; A47F 5/0087; A47F 5/13; A47F 5/12; A47F 5/01; A47F 5/14
USPC .... 312/330.1, 323, 322; 211/99, 100, 131.2, 211/164, 170, 171
See application file for complete search history.

(56) References Cited

U.S. PATENT DOCUMENTS 2,379,975 A * 7/1945 Luger ..... D06F 57/12 211/99
2,615,579 A * 10/1952 Sampson ..... A47G 25/746 211/100
2,809,085 A * 10/1957 Fall ..... H05K 7/1421 312/334.8
2,911,107 A * 11/1959 Francavillo ..... A47F 5/0037 D7/704
3,069,020 A * 12/1962 Sans ..... A47L 23/20 211/162
3,547,258 A * 12/1970 Black ..... A47F 7/04 211/23
3,563,390 A * 2/1971 Kim ..... A47B 61/04 211/35
4,191,436 A * 3/1980 Cherry ..... E05B 65/46 312/333
4,258,967 A * 3/1981 Boudreau ..... H05K 7/1421 312/273
5,027,962 A * 7/1991 Maccarrone ..... A47B 57/04 211/182
5,169,221 A * 12/1992 Wheeler ..... A47B 88/48 248/299.1
5,248,049 A * 9/1993 Murphy, Sr. ..... B25H 3/06 211/164
7,296,697 B2 11/2007 Costa et al.
2006/0144805 A1* 7/2006 Wang ..... A47B 96/024 211/37
2007/0284321 A1* 12/2007 Qiang ..... A47B 61/04 211/38
2014/0110364 A1* 4/2014 Vogel ..... F21S 4/26 211/74
2021/0244179 A1* 8/2021 Felsenthal ..... A47F 7/08

* cited by examiner

ADJUSTABLE STORAGE ASSEMBLY WITH PIVOTAL BARS

TECHNICAL FIELD

Various embodiments relate to storage assemblies with bars for supporting articles.

BACKGROUND

The prior art has provided storage assemblies with bars for supporting articles.

SUMMARY

According to an embodiment, a storage assembly is provided with a pair of spaced apart brackets. A pair of hubs is each pivotally connected to one of the pair of spaced apart brackets. A rotary limit is connected to one of the pair of hubs and one of the pair of spaced apart brackets to limit the pair of hubs to a range of rotation relative to the pair of spaced apart brackets. A pair of bars is each connected to the pair of hubs to rotate with the pair of hubs to support and store articles upon the pair of bars.

According to a further embodiment, the range of rotation of the pair of hubs is ninety degrees.

According to another further embodiment, the rotary limit is further provided with a pin extending from the one of the pair of hubs offset from an axis of rotation of the pair of hubs that is sized to be received in an arcuate slot formed in the one of the pair of spaced apart brackets.

According to another further embodiment, a pair of posts extend from each hub parallel with an axis of rotation of the pair of hubs. The pair of bars is connected to the pair of posts.

According to an even further embodiment, the pair of bars are at least partially hollow, and the pairs of posts are each received within a terminal end of one of the pair of bars.

According to another even further embodiment, a plurality of fasteners is each installed into one of the pairs of posts to expand each post within the corresponding bars to fasten the pair of bars to the pairs of posts.

According to another even further embodiment, a plurality of slits are formed in each of the pairs of posts to permit expansion of the pairs of posts upon installation of the plurality of fasteners.

According to another further embodiment, each of the pairs of posts has a radially asymmetrical cross-section. Each of the pair of bars has a radially asymmetrical cross-section to minimize rotation of each of the pair of bars relative to the pairs of posts.

According to another further embodiment, at least one spring-loaded mechanism is supported upon one of the pair of hubs. At least one detent is formed in one of the pair of spaced apart brackets and aligned to receive the at least one spring-loaded mechanism to maintain a rotary position of the pair of hubs relative to the pair of spaced apart brackets.

According to another further embodiment, the pair of spaced apart brackets are further defined as a pair of spaced apart rails for translation in a length direction of the pair of spaced apart rails.

According to another further embodiment, the storage assembly is packaged separately from a frame to support the pair of spaced apart brackets.

According to another further embodiment, a frame is provided to support the pair of spaced apart brackets.

According to another embodiment, a method of assembling a storage system installs a plurality of spaced apart upright frame members. A pair of horizontal cross members are installed to the plurality of spaced apart upright frame members. A storage assembly is provided with a pair of spaced apart brackets. A pair of hubs is each pivotally connected to one of the pair of spaced apart brackets. A rotary limit is connected to one of the pair of hubs and one of the pair of spaced apart brackets to limit the pair of hubs to a range of rotation relative to the pair of spaced apart brackets. A pair of bars is each connected to the pair of hubs to rotate with the pair of hubs to support and store articles upon the pair of bars. The pair of spaced apart brackets are installed to the pair of horizontal cross members.

According to a further embodiment, the storage assembly is oriented at an offset angle relative to an installed position prior to installing the pair of spaced apart brackets. The pair of spaced apart brackets is engaged to the pair of horizontal cross members at the offset angle. The storage assembly is pivoted to the installed position to install the pair of spaced apart brackets to the pair of horizontal cross members.

According to another further embodiment, the storage assembly is unpacked from a separate retail package than a retail package for the plurality of spaced apart upright frame members and the pair of horizontal cross members.

According to another embodiment, a method for storing articles provides a storage assembly with a pair of spaced apart brackets. A pair of hubs is each pivotally connected to one of the pair of spaced apart brackets. A rotary limit is connected to one of the pair of hubs and one of the pair of spaced apart brackets to limit the pair of hubs to a range of rotation relative to the pair of spaced apart brackets. A pair of bars is each connected to the pair of hubs to rotate with the pair of hubs to support and store articles upon the pair of bars. The pair of hubs are pivoted to a storage orientation. Articles are placed upon the pair of bars for storage upon the pair of bars.

According to a further embodiment, shoes, scarves, ties, pants, jewelry, or belts are placed upon the pair of bars for storage.

According to another further embodiment, a damp clothing article is placed upon the pair of bars for drying upon the storage assembly.

According to another embodiment, a storage assembly is provided with a pair of spaced apart rails for translation in a length direction of the pair of spaced apart rails. A pair of hubs is each pivotally connected to one of the pair of spaced apart rails. A pair of bars is each connected to the pair of hubs to rotate with the pair of hubs to support and store articles upon the pair of bars.

According to another embodiment, a method for storing articles provides a storage assembly with a pair of spaced apart rails for translation in a length direction of the pair of spaced apart rails. A pair of hubs is each pivotally connected to one of the pair of spaced apart rails. A pair of bars is each connected to the pair of hubs to rotate with the pair of hubs to support and store articles upon the pair of bars. The storage assembly is translated to an extended position. The pair of hubs is pivoted to a desired orientation. Articles are placed upon the pair of bars for storage upon the pair of bars. The storage assembly is translated to a retracted position.

According to another embodiment, a storage assembly is provided with a pair of spaced apart brackets. Two pairs of hubs are each pivotally connected to one of the pair of spaced apart brackets at a pair of spaced apart pivotal connections. Two pairs of bars are each connected to one of the two pairs of hubs to rotate with the pairs of hubs to support and store articles upon the pair of bars. The pairs of bars are each equally spaced apart from the corresponding pivotal connection by a distance that is half of a distance between the pair of spaced apart pivotal connections so that the two pairs of bars are equally, sequentially spaced apart when both pairs of bars are pivoted to a coplanar orientation.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
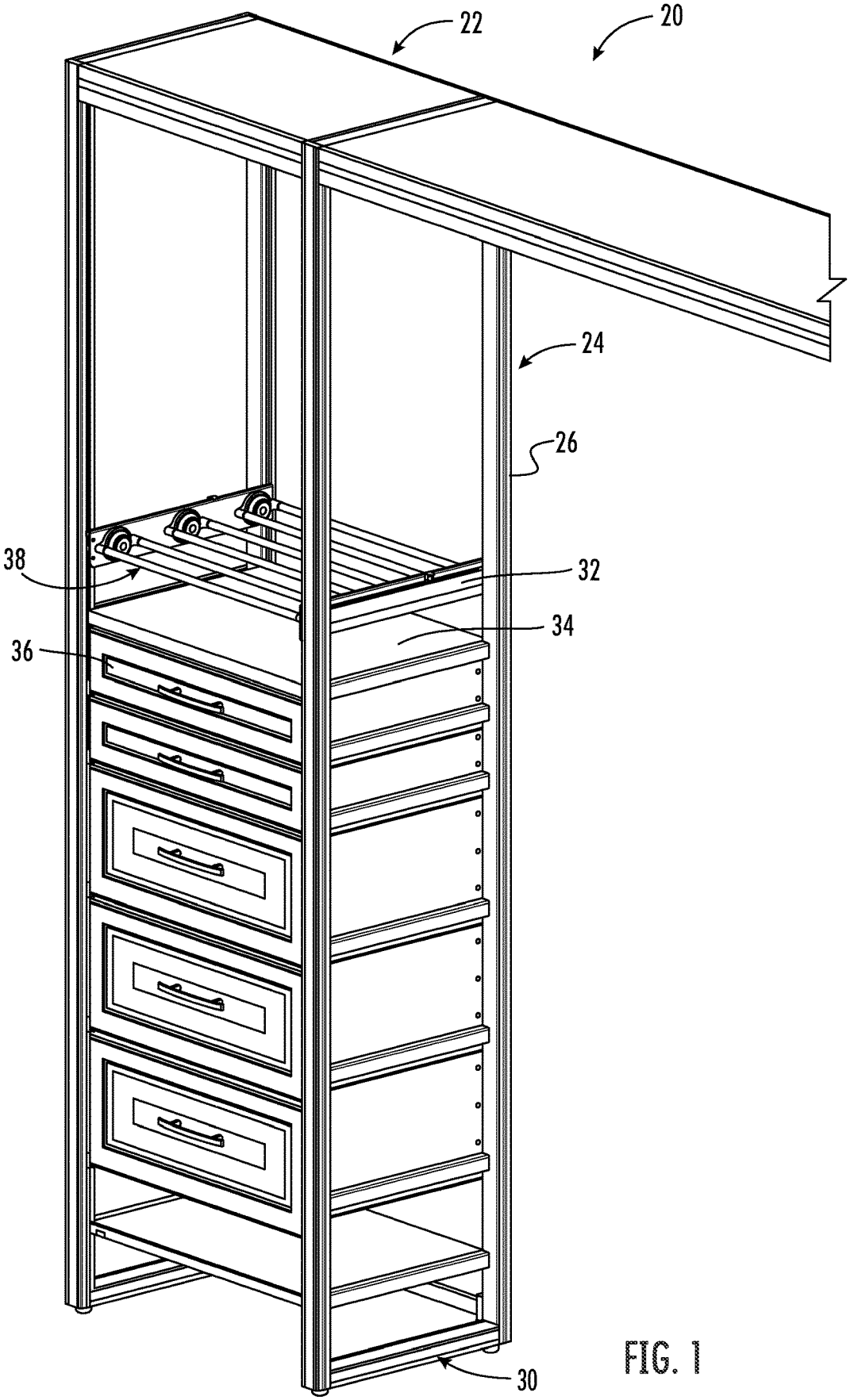
FIG. 1 is a front perspective view of a storage system with a storage assembly according to an embodiment.

FIG. 1 illustrates a modular closet storage system 20 according to an embodiment. The storage system 20 is depicted as a singular unit with a frame and various accessories. The modular closet storage system 20 is repeatable, modular, and adjustable to provide various sizes, arrangements, and configurations to the end user. The modular storage system 20 may employ the components, assemblies, accessories, and features of the modular storage system disclosed in Hegarty et al., U.S. Patent Application Publication No. US 2021/0093082 A1, which published to Liberty Hardware Mfg. Corp., on Apr. 1, 2021, which is incorporated in its entirety by reference herein.

Figure 2:
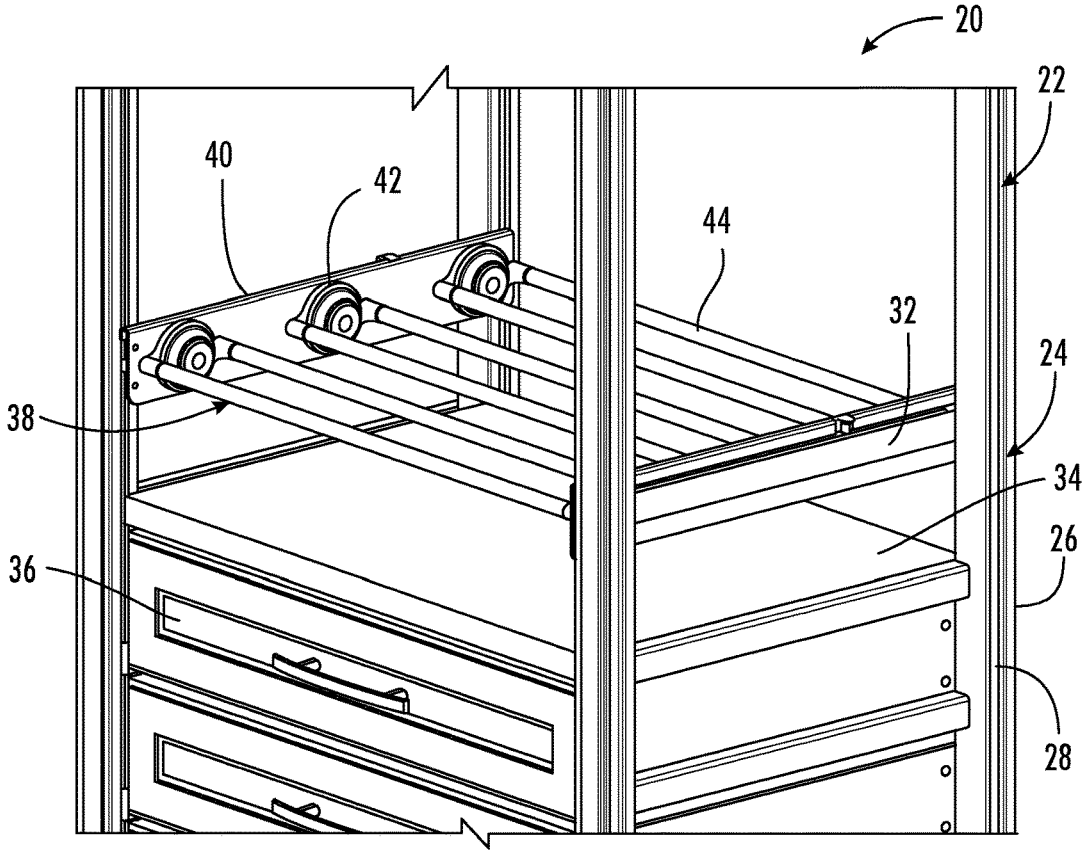
FIG. 2 is an enlarged front perspective view of the storage assembly of the storage system of FIG. 1.
Figure 3:
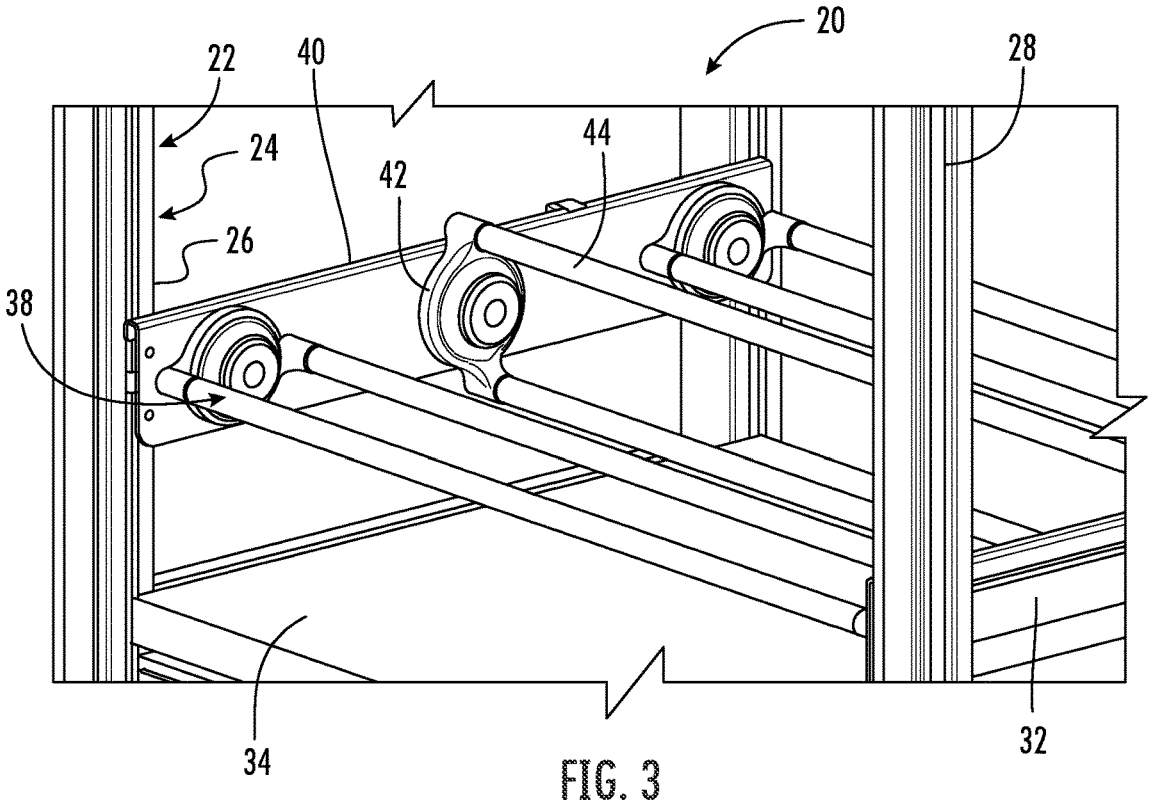
FIG. 3 is another enlarged front perspective view of the storage assembly of the storage system of FIG. 1 illustrated in varying storage positions.
Figure 4:
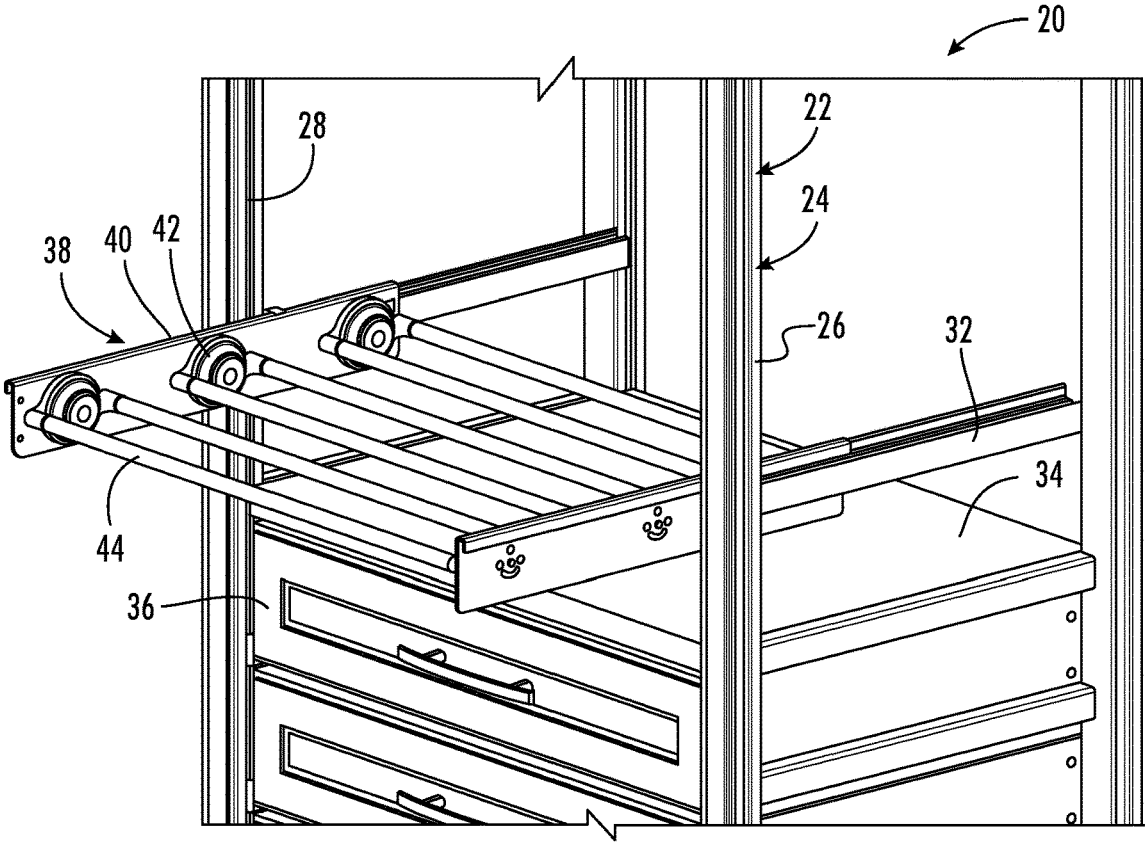
FIG. 4 is another enlarged front perspective view of the storage assembly of the storage system of FIG. 1 illustrated in an extended position.

The storage system includes a modular storage assembly 22. The modular storage assembly 22 provides a frame for one unit of the modular storage system 20. The modular storage assembly 22 includes a pair of upright side support assemblies 24 to be supported upon an underlying support surface, such as a floor. Each of the pair of upright side support assemblies 24 includes a pair of elongate vertical rails 26. The vertical rails 26 may each be formed from a hollow aluminum extrusion. The vertical rails 26 may also each be identical for interchangeability, and simplification of the assembly process. As illustrated in FIGS. 2-4, the vertical rails 26 are also each formed with grooves 28 with a series of incrementally spaced apart slots (not shown) formed within the grooves 28 for mounting hardware at various locations.

Referring again to FIG. 1, the side support assemblies 24 also include a plurality of shorter horizontal rails 30. The horizontal rails 30 are also formed from extruded aluminum with a similar profile to the vertical rails 26. The horizontal rails 30 are each interchangeable for ease in assembly. The vertical rails 26 and the horizontal rails 30 may also be mitered to be assembled together.

The modular storage assembly 22 is a primary storage assembly 22 that is packaged separately for providing closet storage or a unit of closet storage. The modular storage assembly 22 is configured to receive and support various closet accessories at various orientations. The accessories can be prepackaged in separate kits so that the end customer can select and modify the modular storage system 20.

The storage system 20 is provided with a plurality of accessory brackets 32 for supporting various accessories in the storage system 20. The accessory brackets 32 are horizontal cross members that interconnect a pair of the vertical rails 26. The accessory brackets 32 may be stationary brackets 32 to support shelves 34. The accessory brackets 32 may also provide a stationary portion of a slide assembly to support translatable accessories, such as drawers 36. Shelf and drawer brackets 32 are illustrated and described in greater detail in Hegarty et al., U.S. Patent Application Publication No. US 2021/0093082 A1, which is incorporated by reference herein.

Referring now to FIGS. 1-4, the storage system 20 is provided with an accessory storage assembly 38 mounted to a pair of the accessory brackets 32. The accessory storage assembly 38 may be employed for supporting various articles, such as footwear, clothing, and clothing accessories. FIGS. 2-4 illustrate the accessory storage assembly 38 in greater detail. The accessory storage assembly 38 includes a pair of spaced apart brackets 40 that are mounted on the accessory bracket 32. According to an embodiment, the brackets 40 are a mobile portion or a rail, of a slide assembly for translation of the accessory storage assembly 38 in a length direction of the brackets 40, from a stowed position of FIGS. 1-3 to an extended position of FIG. 4. The extension and retraction of the accessory storage assembly 38 permits a user to extend the assembly 38, access articles stored upon the assembly 38, and then stow the assembly 38 for storage. Alternatively, the accessory storage assembly 38 may be stationary, and the side brackets 40 may install directly to the storage system 20 without an additional pair of accessory brackets 32.

The accessory storage assembly 38 includes a plurality of hubs 42 pivotally connected to the side brackets 40. Although six hubs 42 are illustrated, any quantity of hubs 42 may be employed. Three hubs 42 are provided on each side bracket 40. The hubs 42 are spaced apart incrementally and are aligned with the hubs 42 on the opposed side bracket 40. Each pair of opposed hubs 42 supports a pair of bars 44 extending across the assembly 38 to support and store articles upon the pairs of bars 44. Rotation of the hubs 42, rotates the bars 44 to various positions to support articles.

Each pair of bars 44 is spaced apart on the corresponding hub 42. The spacing of the bars 44 is equidistant from the pivotal connection of the hub 42. Additionally, the spacing of each pair of bars 44 is half of a distance of sequential pairs of hubs 42 so that each of the bars 44 is equally spaced apart when oriented in a coplanar horizontal array as illustrated in FIGS. 2 and 4. When each pair of bars 44 is rotated to the horizontal orientation of FIGS. 2 and 4, the bars 44 collectively provide a storage platform. The bars 44 may pivoted to various orientations. FIG. 3 illustrates two pairs of the bars 44 rotated ninety degrees to a vertical orientation for a desired storage position for supporting articles.

The accessory storage assembly 38 permits the user to configure the bars 44 to desired storage positions. By allowing the bars 44 to rotate, sections of the article support surface can be rotated, such as by ninety degrees to appropriately support a variety of footwear types and allow for other secondary uses in the closet. Typical shoe storage systems are optimized for a single type of footwear. Some prior art systems, with vertically aligned, or inclined rails work well for supporting boots or high heel shoes but are not well suited for storage of sneakers or other flat footwear. Other prior art systems with horizontal support surfaces work well for storage of sneakers and low-profile footwear. In addition, a possible range of shoe sizes is an added challenge for prior art shoe storage solutions. The accessory storage assembly 38 permits the user to configure the bars 44 according the shape and size of the articles or shoes by pivoting each pair of bars to various angular positions, such as horizontal, vertical, inclined, declined, or the like, to support and store all footwear types in a space efficient manner.

The bars 44 also function as storage for hanging items that can be draped over the rotating bars. Examples include pants, jewelry, scarves, belts, and ties. The accessory storage assembly 38 may also be employed as a drying rack for drying damp or wet articles.

Figure 5:
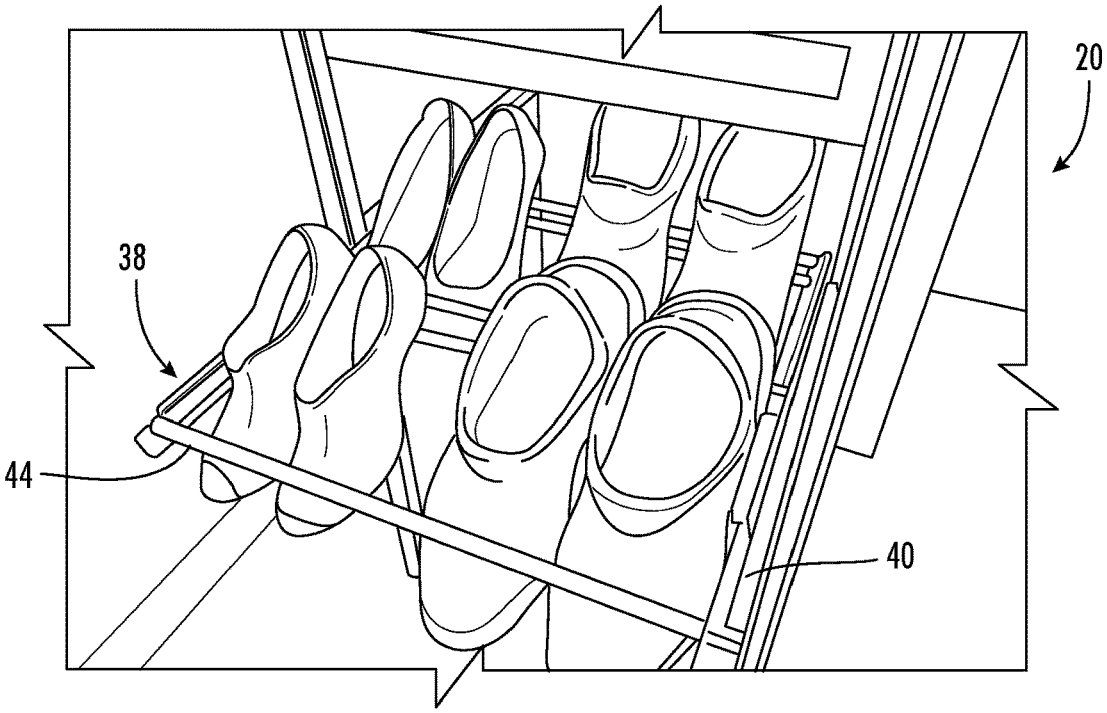
FIG. 5 is a front perspective view of a storage system with a storage assembly according to another embodiment, illustrated in an extended position.
Figure 6:
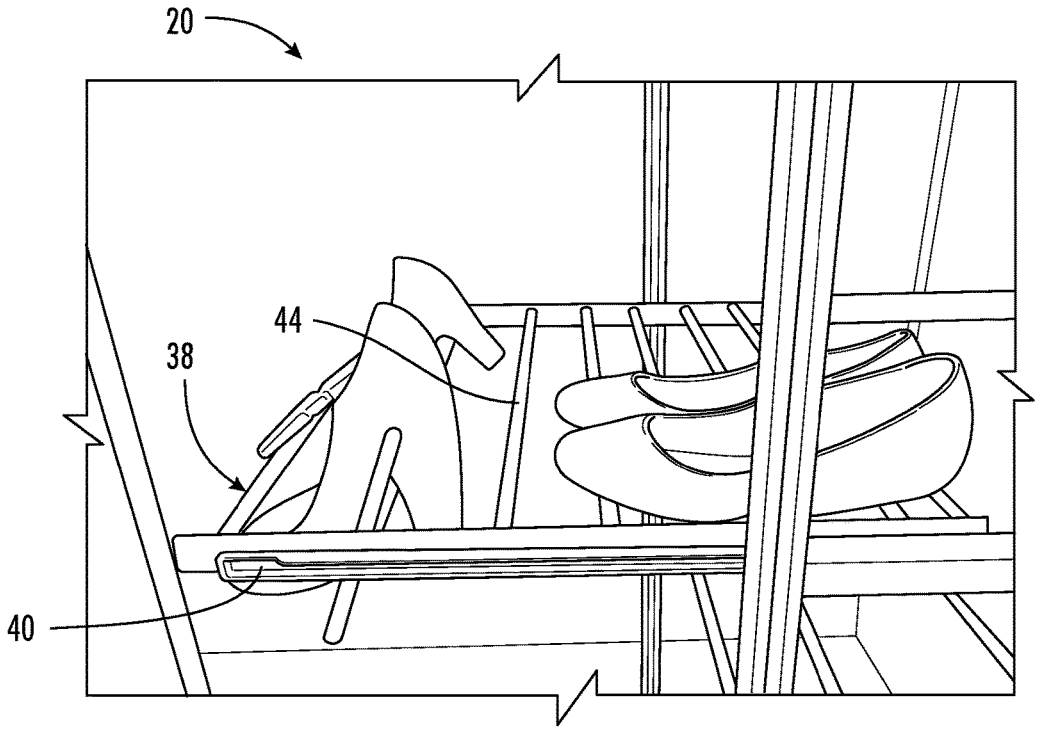
FIG. 6 is a side perspective view of a storage system with a storage assembly according to another embodiment, illustrated in an extended position.

FIG. 5 illustrates the storage system 20 according to another embodiment. The accessory storage assembly 38 is illustrated extended. The bars 44 are angled to incline in a rearward direction to provide support and storage for a plurality of footwear. FIG. 6 illustrates the storage system 20 according to another embodiment. The accessory storage assembly 38 is also illustrated extended. Some of the bars 44 are oriented at an upright angle to support high heeled shoes, while other bars 44 are oriented horizontally to support low profile footwear.

Figure 7:
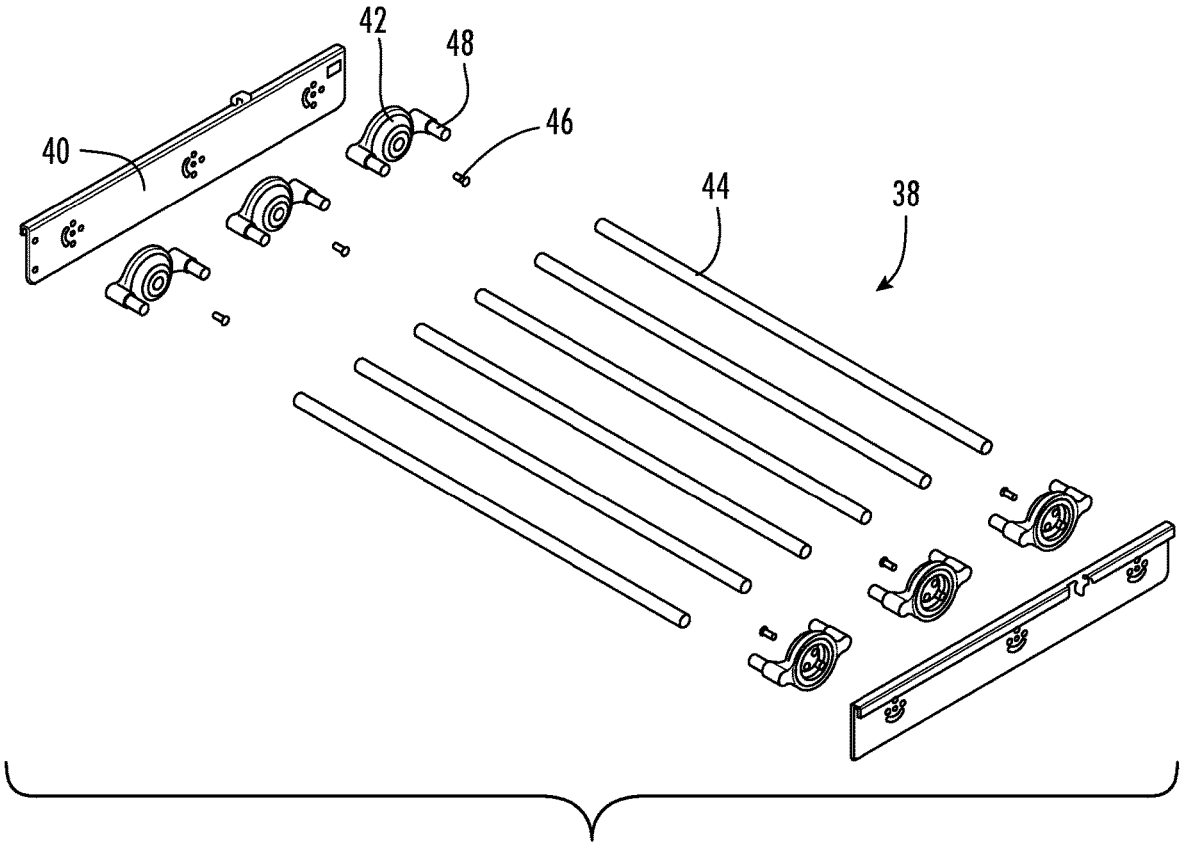
FIG. 7 is an exploded perspective view of the storage assembly of FIG. 1, according to an embodiment.

FIG. 7 is an exploded view of the accessory storage assembly 38. The accessory storage assembly 38 may be packaged separately from the storage assembly 22 for customer selection and customization of the storage assembly 22 at retail. The user unpacks the accessory storage assembly 38 and installs the assembly 38 into the storage system 20. The side brackets 40 may be conventional slide top rails that are installed by pivoting the assembly 38 offset from horizontal, engaging the side brackets 40 to the accessory brackets 32, and pivoting the side brackets 40 to horizontal for connection and translation relative to the accessory brackets 32. The side brackets 40 can only be installed to the accessory brackets 32 in a vertical orientation to prevent tipping or accidental disengagement when the accessory storage assembly 38 is in the extended position.

The hubs 42 are each pivotally connected to one of the side brackets 40 by a central fastener 46. The fasteners 46 each extend through one of the hubs 42 and into one of the side brackets 40 to permit the hubs 42 to pivot about the fasteners 46. Each hub 42 includes a pair of posts 48 extending laterally inward from the hub 42 and parallel with an axis of rotation about the fastener 46. The bars 44 are each tubular or at least partially hollow to receive the posts 48 in terminal ends of each bar 44.

Figure 8:
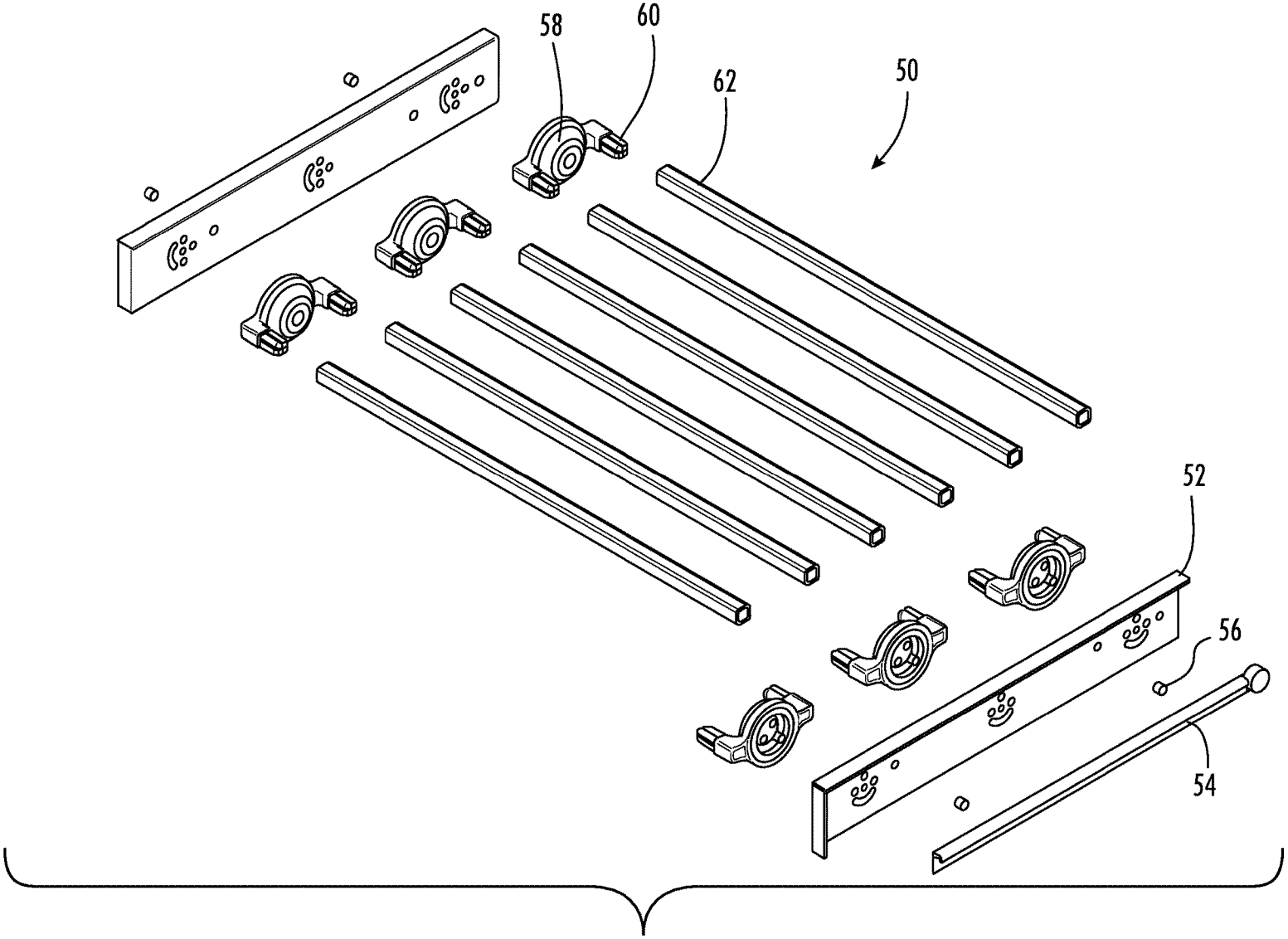
FIG. 8 is an exploded perspective view of the storage assembly of FIG. 1, according to another embodiment.

FIG. 8 illustrates an accessory storage assembly 50 according to another embodiment. The assembly includes a pair of brackets 52 that each attached to one of a pair of slide assemblies 54 with a plurality of rivet studs 56. The slide assemblies 54 are connected to a pair of accessory brackets 32 for support of the accessory storage assembly 50 in the storage system 20. The slide assemblies 54 also permit extension and retraction of the accessory storage assembly 50 relative to the storage system 20.

The accessory storage assembly 50 includes a plurality of hubs 58, each pivotally connected to one of the side brackets 52. A pair of posts 60 extend laterally inward from each hub 58 to support a pair of bars 62 between pair of opposed hubs 58. The hubs 58 and bars 62 are illustrated in greater detail in FIGS. 9-11. The bars 62 are each formed from an extruded material such as aluminum with a tubular cross section. The cross section of the bars 62 is radially asymmetrical. For example, the cross section of the bars 62 is a rounded square. Each of the posts 60 have a corresponding radially asymmetrical cross section for receipt within one of the terminal ends of the bars 62. The radial asymmetry of the posts 60 and the bars 62 minimizes rotation of the bars 62 relative to the posts 60. By preventing rotation of the bars 62 relative to the posts 60, the pair of hubs 58 rotate together without twisting of the bars 62 out of parallel. By avoiding twisting of the bars 62, binding of the bars 62 and hubs 58 is avoided, and consequentially racking and binding of the accessory storage assembly 50 is avoided along the slide assemblies 54.

The squared bars 62 also provide increased traction to articles stored upon the bars 62. According to another embodiment, the bars 62 are provided with an external knurl or texture to increase friction for contact with the stored articles. According to another embodiment, the bars 62 are coated with a high friction material, such as a polymeric material, such as thermoplastic, rubber, or the like.

Figure 9:
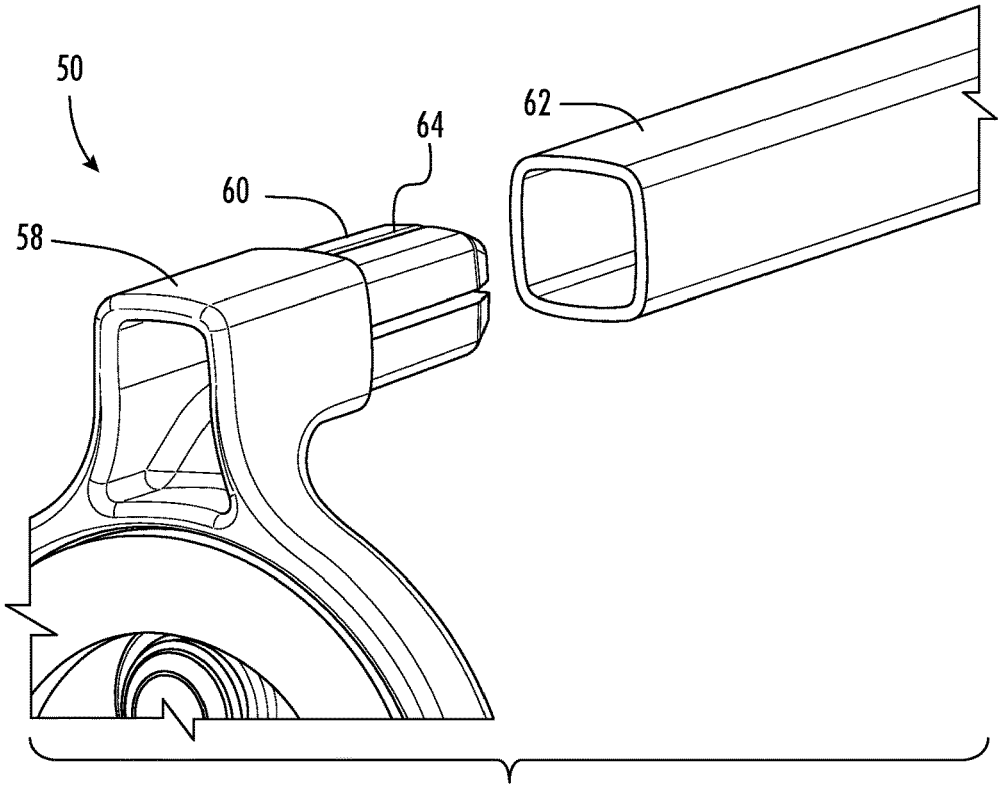
FIG. 9 is an enlarged exploded perspective view of a portion of the storage assembly of FIG. 8.
Figure 10:
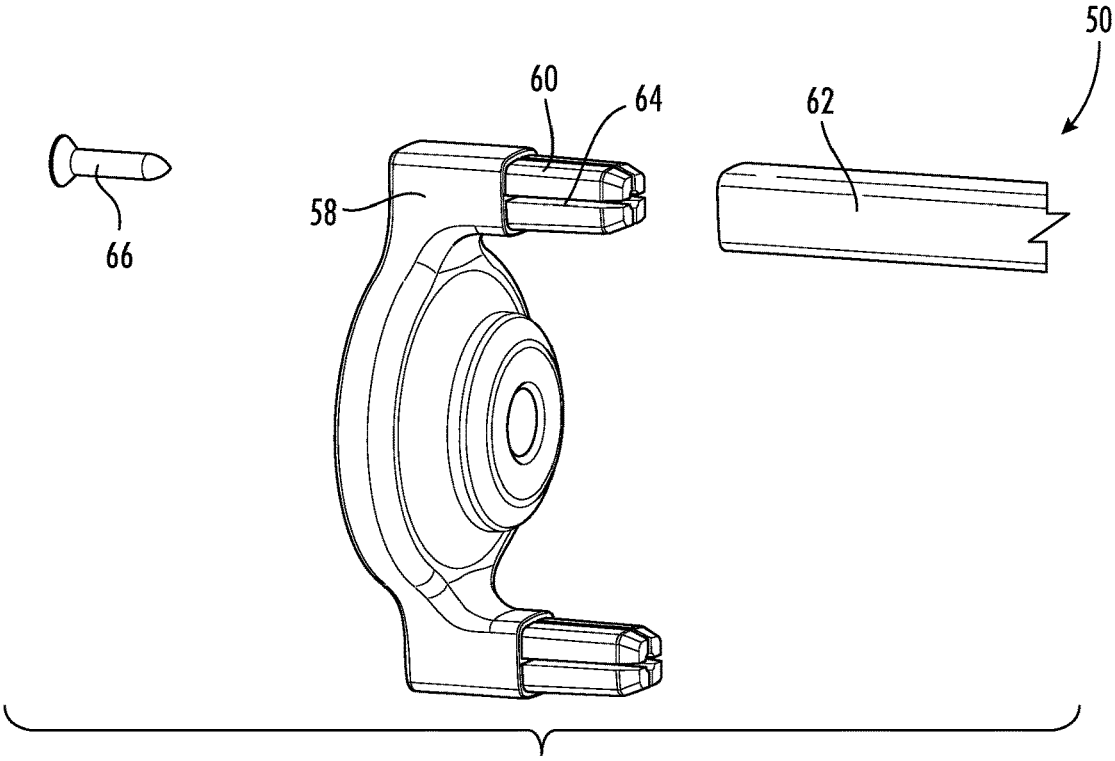
FIG. 10 is another enlarged exploded perspective view of a portion of the storage assembly of FIG. 8.
Figure 11:
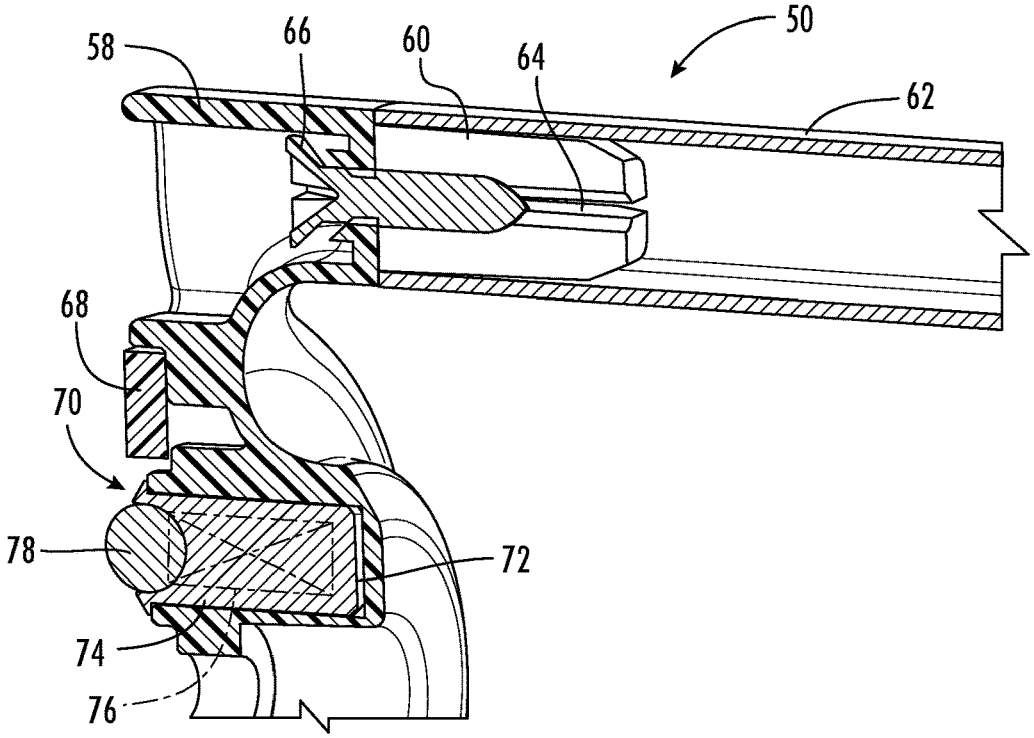
FIG. 11 is an enlarged partial section view of a portion of the storage assembly of FIG. 8.
Figure 12:
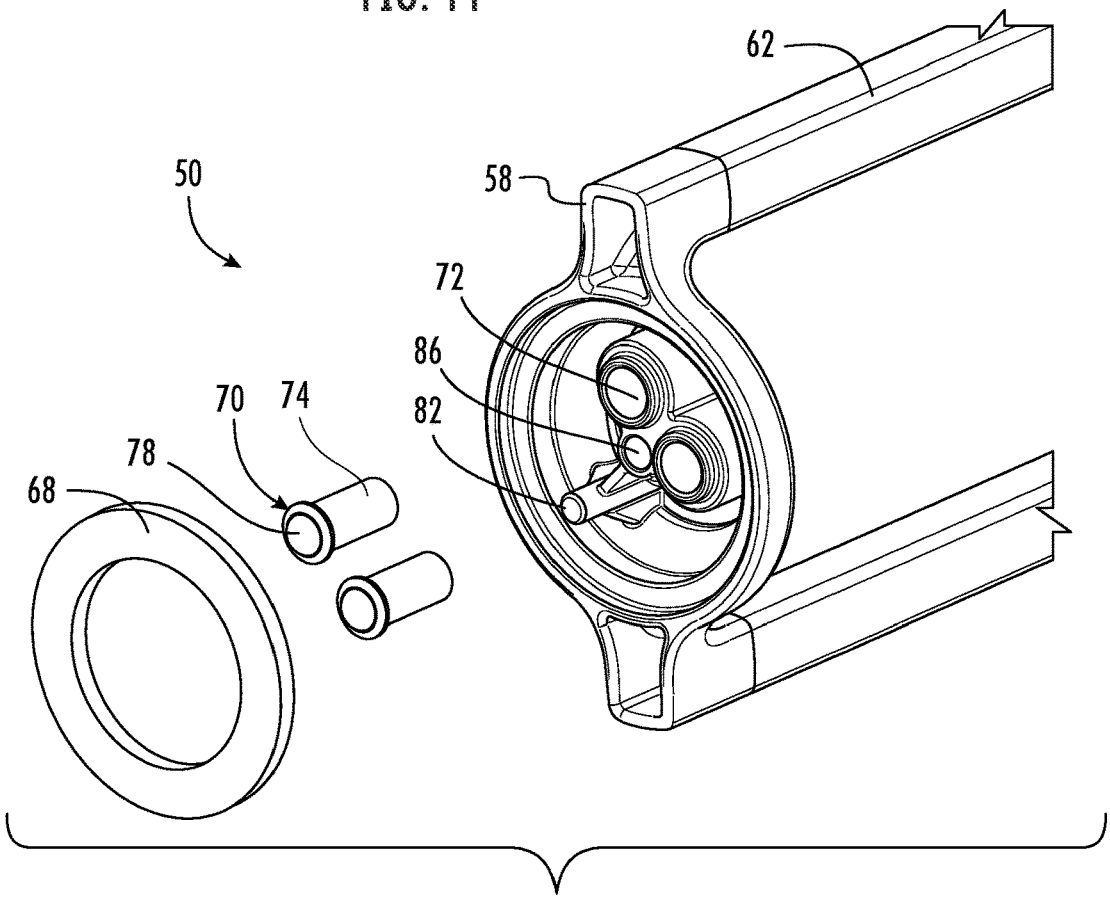
FIG. 12 is another enlarged exploded perspective view of a portion of the storage assembly of FIG. 8.
Figure 13:
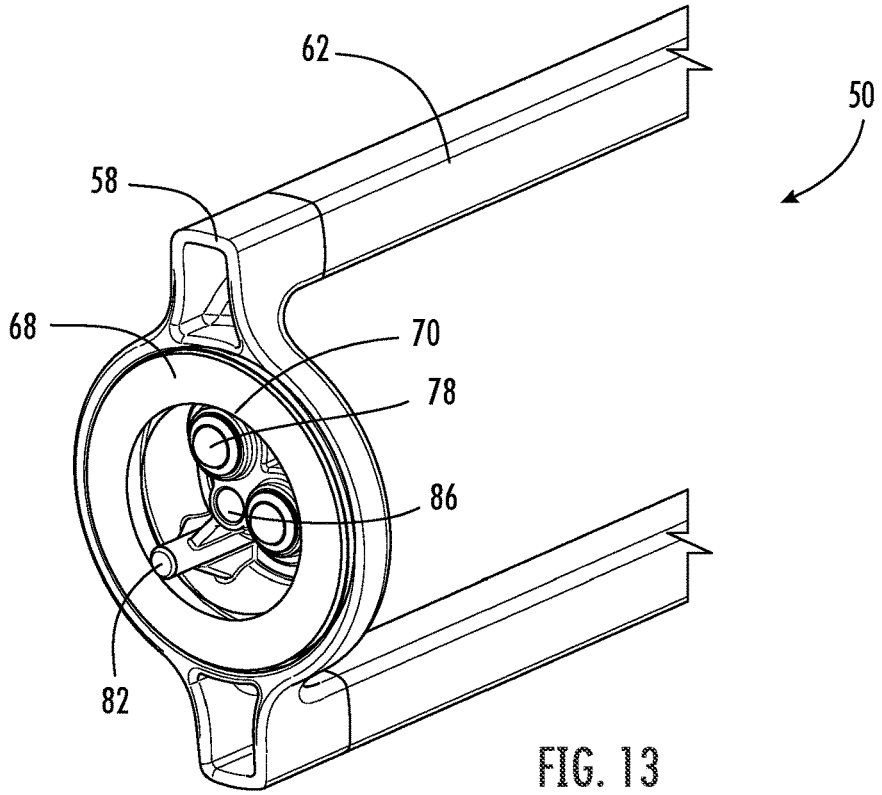
FIG. 13 is an enlarged perspective view of a portion of the storage assembly of FIG. 8.

With continued reference to FIGS. 9-11, the hubs 58 may be formed from a polymeric material that provides strength and flexibility, such as a nylon material with a partial fiberglass filler. The posts 60 are formed with a plurality of slits 64 formed partially within the posts 60 lengthwise to permit expansion of the posts 60. After the posts 60 are inserted into the bars 62, threaded fasteners 66 are installed into the hubs 58 and into the posts 60. The fasteners 66 cause the posts 60 to expand and provide a compression attachment of the posts 60 within the bars 62.

Referring now to FIGS. 11-14, a smooth nylon ring 68 is installed into a rear of the hubs 58. The nylon ring 68 provides a contact between the hubs 58 and the side brackets 52 to reduce friction between the hubs 58 and the side brackets 52 for smooth rotation of the hubs 58. A pair of detent mechanisms 70 are installed into a pair of receptacles 72 in the hubs 58 for cooperation with the side brackets 52. Referring to FIG. 11, each detent mechanism 70 includes a sleeve 74 with a spring 76 retained within the sleeve 74 beneath an exposed ball bearing 78.

Figure 14:
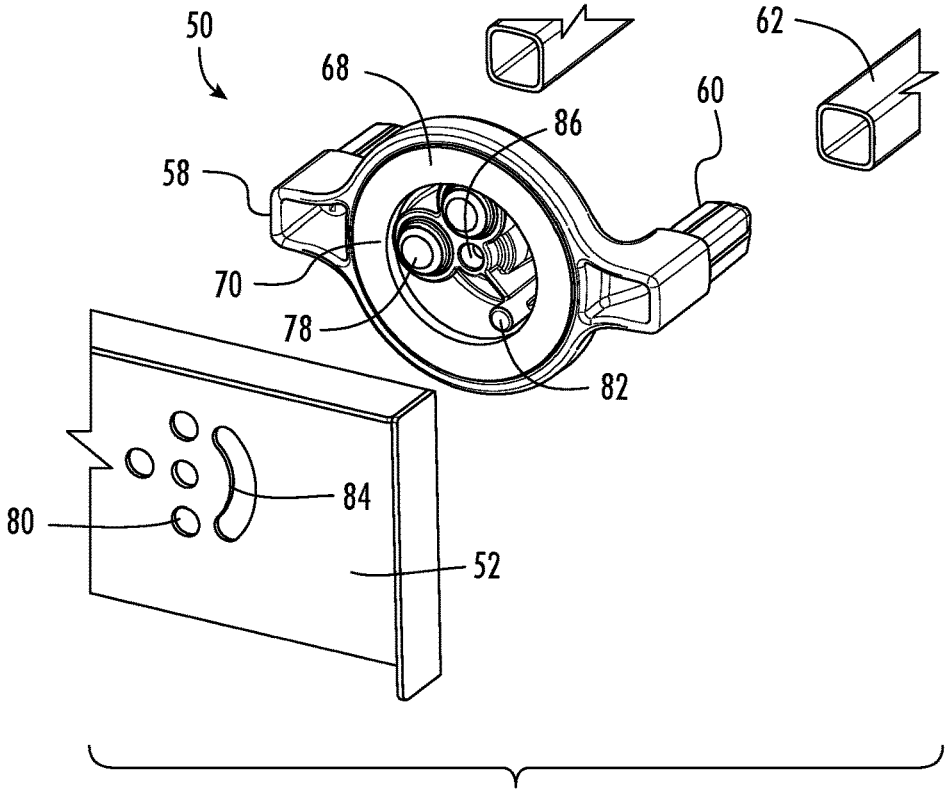
FIG. 14 is another enlarged exploded perspective view of a portion of the storage assembly of FIG. 8.
Figure 15:
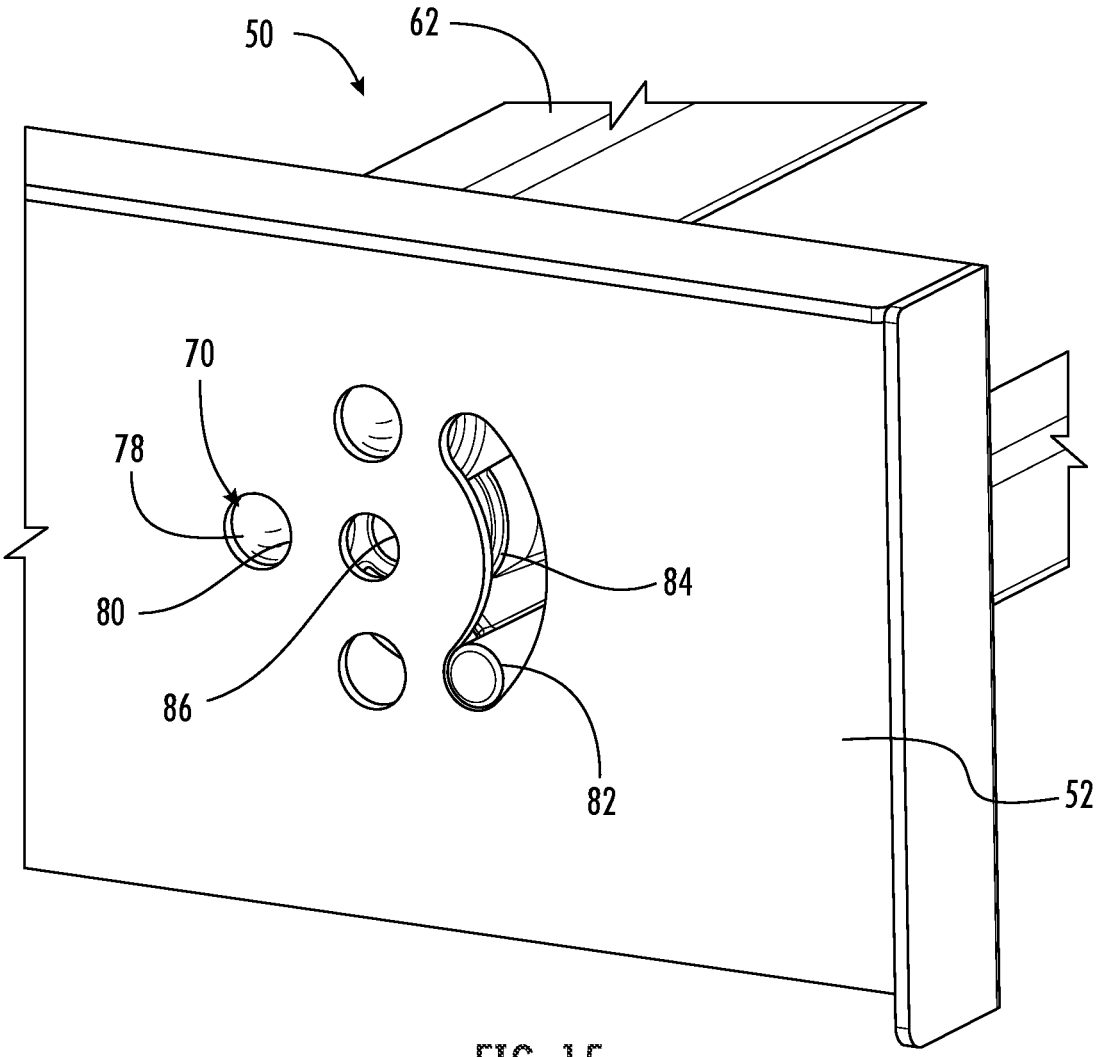
FIG. 15 is another enlarged perspective view of a portion of the storage assembly of FIG. 8.

Referring now to FIGS. 14 and 15, a plurality of apertures 80 are formed in the side brackets 52 for cooperation with the spring-loaded balls 78. The apertures 80 are aligned with the detent mechanisms 70 at various orientations of the hubs 58 to receive the spring-loaded balls 78 and to maintain the hubs 58 at a rotary position of the hubs 58 relative to the side brackets 52. For example, the apertures 80 may align with the spring-loaded balls 78 at the horizontal and vertical orientations of the bars 62, to maintain the bars 62 in these positions. The cooperation of the spring-loaded balls 78 and the apertures 80 also provides a haptic and audible feedback to the user indicative of a positive engagement of the hubs 58 into an angular adjustment.

FIGS. 12-15 illustrate the hub 58 also includes a peg 82 or a pin, extending laterally away from the hub 58 and into the engagement within an arcuate slot 84 in the side brackets 52. The peg 82 is offset from a pivot axis 86 of the hub 58. The slot 84 limits rotation of the hub 58 to a rotary range by engagement of the peg 82 at angular limits. According to an embodiment, the hubs 58 are limited to a range or rotation of ninety degrees. The limited range of rotation avoids pinching or entrapment of articles, or other objects between sequential bars 62.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A storage assembly comprising:

a pair of spaced apart brackets;

a pair of hubs, each pivotally connected to one of the pair of spaced apart brackets;

a rotary limit connected to one of the pair of hubs and one of the pair of spaced apart brackets to limit the pair of hubs to a range of rotation relative to the pair of spaced apart brackets; and a pair of bars each connected to the pair of hubs to rotate with the pair of hubs to support and store articles upon the pair of bars;

a pair of posts extending from each hub parallel with an axis of rotation of the pair of hubs, wherein the pair of bars is connected to the pair of posts, the pair of bars are at least partially hollow, and the pairs of posts are each received within a terminal end of one of the pair of bars; and a plurality of fasteners each installed into one of the pairs of posts to expand each post within the corresponding bar to fasten the pair of bars to the pairs of posts.

2. The storage assembly of claim 1 wherein the rotary limit further comprises a pin extending from the one of the pair of hubs offset from an axis of rotation of the pair of hubs that is sized to be received in an arcuate slot formed in the one of the pair of spaced apart brackets.

3. The storage assembly of claim 1 wherein a plurality of slits is formed in each of the pairs of posts to permit expansion of the pairs of posts upon installation of the plurality of fasteners.

4. The storage assembly of claim 1 wherein each of the pairs of posts has a radially asymmetrical cross-section; and wherein each of the pair of bars has a radially asymmetrical cross-section to minimize rotation of each of the pair of bars relative to the pairs of posts.

5. The storage assembly of claim 1 further comprising at least one spring-loaded mechanism supported upon one of the pair of hubs; and wherein at least one detent is formed in one of the pair of spaced apart brackets and aligned to receive the at least one spring-loaded mechanism to maintain a rotary position of the pair of hubs relative to the pair of spaced apart brackets.

6. The storage assembly of claim 1 wherein the pair of spaced apart brackets are further defined as a pair of spaced apart rails for translation in a length direction of the pair of spaced apart rails.

7. The storage assembly of claim 1 wherein the storage assembly is packaged separately from a frame to support the pair of spaced apart brackets.

8. The storage assembly of claim 1 further comprising a frame to support the pair of spaced apart brackets.

9. A method of assembling a storage system, comprising:

providing the storage assembly of claim 1;

installing a plurality of spaced apart upright frame members;

installing a pair of horizontal cross members to the plurality of spaced apart upright frame members; and installing the pair of spaced apart brackets to the pair of horizontal cross members.

10. The method of claim 9 further comprising:

orienting the storage assembly at an offset angle relative to an installed position prior to installing the pair of spaced apart brackets;

engaging the pair of spaced apart brackets to the pair of horizontal cross members at the offset angle; and pivoting the storage assembly to the installed position to install the pair of spaced apart brackets to the pair of horizontal cross members.

11. The method of claim 9 further comprising unpacking the storage assembly from a separate retail package than a retail package for the plurality of spaced apart upright frame members and the pair of horizontal cross members.

12. A method for storing articles comprising:

providing the storage assembly of claim 1;

pivoting the pair of hubs to a storage orientation; and placing articles upon the pair of bars for storage upon the pair of bars.

13. The method of claim 12 further comprising placing shoes, scarves, ties, pants, jewelry, or belts upon the pair of bars for storage.

14. The method of claim 12 further comprising placing a damp clothing article upon the pair of bars for drying upon the storage assembly.

15. A storage assembly comprising:

a pair of spaced apart rails for translation in a length direction of the pair of spaced apart rails;

a pair of hubs, each pivotally connected to one of the pair of spaced apart rails; and a pair of bars each connected to the pair of hubs to rotate with the pair of hubs to support and store articles upon the pair of bars;

a pair of posts extending from each hub parallel with an axis of rotation of the pair of hubs, wherein the pair of bars is connected to the pair of posts, wherein each of the pairs of posts has a radially asymmetrical cross-section; and wherein each of the pair of bars has a radially asymmetrical cross-section to minimize rotation of each of the pair of bars relative to the pairs of posts.

16. The storage assembly of claim 15 wherein the pair of bars is connected to the pair of posts, the pair of bars are at least partially hollow, and the pairs of posts are each received within a terminal end of one of the pair of bars.

17. The storage assembly of claim 16 further comprising:

a plurality of fasteners each installed into one of the pairs of posts to expand each post within the corresponding bar to fasten the pair of bars to the pairs of posts.

18. A method for storing articles comprising:

providing the storage assembly of claim 15;

translating the storage assembly to an extended position;

pivoting the pair of hubs to a desired orientation;

placing articles upon the pair of bars for storage upon the pair of bars; and translating the storage assembly to a retracted position.

19. A storage assembly comprising:

a pair of spaced apart brackets;

two pairs of hubs, each pivotally connected to one of the pair of spaced apart brackets at a pair of spaced apart pivotal connections; and two pairs of bars each connected to one of the two pairs of hubs to rotate with the pairs of hubs to support and store articles upon the pair of bars, wherein the pairs of bars are each equally spaced apart from the corresponding pivotal connection by a distance that is half of a distance between the pair of spaced apart pivotal connections so that the two pairs of bars are equally, sequentially spaced apart when both pairs of bars are pivoted to a coplanar orientation;

two pairs of posts each extending from one of the two pairs of hubs and parallel with an axis of rotation of each pair of hubs, wherein the two pairs of bars are connected to the two pairs of posts; and a plurality of fasteners each installed into one of the two pairs of posts to expand each post within the corresponding bar to fasten the two pairs of bars to the two pairs of posts.

20. The storage assembly of claim 19 wherein each of the two pairs of posts has a radially asymmetrical cross-section; and wherein each of the two pair of bars has a radially asymmetrical cross-section to minimize rotation of each of the two pairs of bars relative to the two pairs of posts.

* * * * *